US010711754B2

(12) United States Patent
Nelson et al.

(10) Patent No.: US 10,711,754 B2
(45) Date of Patent: Jul. 14, 2020

(54) VALVE ASSEMBLY HAVING ELECTRICAL ACTUATOR WITH STEPPED ARMATURE

(71) Applicant: Caterpillar Inc., Peoria, IL (US)

(72) Inventors: Bryan Edward Nelson, Chillicothe, IL (US); Sana Mahmood, Albuquerque, NM (US); Stephen R Lewis, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 307 days.

(21) Appl. No.: 15/833,156

(22) Filed: Dec. 6, 2017

(65) Prior Publication Data

US 2019/0170267 A1 Jun. 6, 2019

(51) Int. Cl.

| | |
|---|---|
| ***F02M 63/00*** | (2006.01) |
| ***F02M 59/46*** | (2006.01) |
| ***F02M 51/06*** | (2006.01) |
| ***F04B 1/0452*** | (2020.01) |
| ***F04B 7/00*** | (2006.01) |
| ***F02M 59/36*** | (2006.01) |
| *F02M 47/02* | (2006.01) |

(52) U.S. Cl.

CPC .... *F02M 63/0075* (2013.01); *F02M 51/0628* (2013.01); *F02M 51/0635* (2013.01); *F02M 51/0642* (2013.01); *F02M 59/366* (2013.01); *F02M 59/466* (2013.01); *F04B 1/0452* (2013.01); *F04B 7/0076* (2013.01); *F02M 47/027* (2013.01); *F02M 59/368* (2013.01); *F02M 2200/07* (2013.01)

(58) Field of Classification Search

CPC .. F02M 47/027; F02M 59/366; F02M 59/466; F02M 63/0015; F02M 63/0017; F02M 63/0075; F02M 2547/003; F02M 51/0628; F02M 51/0635; F02M 51/0642; F04B 1/0452; F04B 7/0076; F04B 39/08; F04B 49/225; F04B 49/243; F04B 53/10

See application file for complete search history.

(56) References Cited

U.S. PATENT DOCUMENTS

| | | | | |
|---|---|---|---|---|
| 3,592,392 A | | 7/1971 | Huber | |
| 4,875,742 A | | 10/1989 | Hawker | |
| 5,155,461 A | | 10/1992 | Teerman et al. | |
| 5,339,063 A | | 8/1994 | Pham | |
| 5,341,994 A | * | 8/1994 | Wakeman | F02M 51/0653 239/585.5 |
| 5,743,238 A | | 4/1998 | Shorey et al. | |
| 6,550,699 B2 | * | 4/2003 | Nagai | F02M 47/027 239/585.1 |

(Continued)

FOREIGN PATENT DOCUMENTS

JP 9273460 A 10/1997

*Primary Examiner* — Peter J Bertheaud

(74) *Attorney, Agent, or Firm* — Brannon Sowers & Cracraft

(57) ABSTRACT

A valve assembly for a pump includes an electrical actuator having a stator and an armature, where the armature includes a top armature surface facing the stator and having an inwardly stepped-up profile that forms a raised surface at a radially inward location, and a lower, gap-forming surface at a radially outward location that forms a gap between the armature and the stator when the electrical actuator is activated to facilitate displacing fluid and avoiding production of high velocity, potentially damaging fluid flows.

15 Claims, 3 Drawing Sheets

(56) References Cited

U.S. PATENT DOCUMENTS

| | | | | |
|---|---|---|---|---|
| 6,982,619 | B2 | 1/2006 | Nussio | |
| 7,470,117 | B2 * | 12/2008 | Shafer | F02M 59/365 417/307 |
| 7,766,303 | B2 * | 8/2010 | Kaneko | F02M 63/0015 251/129.16 |
| 7,946,276 | B2 * | 5/2011 | Pusch | F02M 61/166 123/472 |
| 9,281,114 | B2 | 3/2016 | Oberle | |
| 9,297,471 | B2 | 3/2016 | Arikawa et al. | |

* cited by examiner

VALVE ASSEMBLY HAVING ELECTRICAL ACTUATOR WITH STEPPED ARMATURE

TECHNICAL FIELD

The present disclosure relates generally to armature design and operation in electrical actuators, and more particularly to a valve assembly having an electrical actuator armature shaped to limit high velocity flows of fluid displaced by movement of the armature in the valve assembly.

BACKGROUND

A great many different pump designs are used for transferring and pressurizing fluids. In the context of fuel systems, such as for internal combustion engines, electronically-controlled, high-pressure fuel pumps are commonplace and used to pressurize a fuel such as diesel fuel for injection into an engine cylinder. Highly pressurized fuel injection strategies have been shown to be effective for reduced emissions operation. In one design, a high pressure fuel pump feeds a so-called common rail that provides a fluid reservoir storing a quantity of pressurized fuel for delivery to a plurality of fuel injectors. In other designs, fuel pumps are associated individually with fuel injectors, and are known as unit pumps.

To achieve a high level of control of moving parts within such pumps, electrical actuators such as solenoid actuators are used to control valve positioning and fluid connections. Solenoids produce a magnetic field when electrical current is applied that can generate local forces with sufficient energy to actuate components within the fuel system hardware. Engineers have experimented with a wide variety of different electrical actuator and pump designs over the years. With the drive toward ever-increasing pressure and control over fuel injection amount, fuel injection rate and other properties, the electrical actuators and associated valve components within fuel pumps tend to move relatively rapidly and can impact valve seats, stops, or other surfaces with relatively high forces. One example fuel pump design is known from U.S. Pat. No. 5,743,238 to Shorey et al. In the configuration shown in Shorey et al., an electrical actuator is used to control a valve that apparently varies position to alternately allow or inhibit fuel flow to a pumping chamber.

SUMMARY OF THE INVENTION

In one aspect, a valve assembly includes a valve member, and an electrical actuator having a stator and an armature coupled to the valve member. The armature includes an armature plate defining an armature center axis, and being movable between a rest position and an activated position to vary a position of the valve member, in response to a change to an energy state of the electrical actuator. The armature plate includes a top armature surface facing the stator, a bottom armature surface, and an outer perimetric surface extending circumferentially around the armature center axis and axially between the top armature surface and the bottom armature surface. The top armature surface has an inwardly stepped-up profile that forms a raised surface at a radially inward location that is adjacent to the stator at the activated position, and a lower, gap-forming surface at a radially outward location that forms a gap between the armature and the stator at the activated position.

In another aspect, a method of operating a valve assembly includes changing an energy state of an electrical actuator of the valve assembly, and moving an armature coupled with a valve member in the valve assembly from a rest position toward a stator in the electrical actuator in response to the change to the energy state of the electrical actuator. The method further includes stopping the moving of the armature at an activated position at which a raised surface at a radially inward location of the armature is adjacent to a face of the stator. The method further includes forming a gap at the activated position between a lower, gap-forming surface at a radially outward location of the armature and the face of the stator, and displacing a fluid from between the armature and the stator by way of the gap.

In still another aspect, a pump includes a pump housing, and a pumping element movable between a retracted position and an advanced position within a pumping chamber formed in the pump housing. The pump further includes a valve assembly for controlling a flow of a fluid to or from the pumping chamber, and including a valve member, and an electrical actuator for adjusting a position of the valve member. The electrical actuator includes a stator, and an armature having a top armature surface facing the stator, and a bottom armature surface, and the top armature surface having an inwardly stepped-up profile that forms a raised surface at a radially inward location, and a lower, gap-forming surface at a radially outward location. The armature is at a rest position where each of the raised surface and the lower, gap-forming surface are spaced from the stator, and being movable to an activated position where the raised surface is adjacent to the stator and the lower, gap-forming surface is spaced from the stator and forms a gap for displacing fluid from between the armature and the stator.

DETAILED DESCRIPTION

Figure 1:
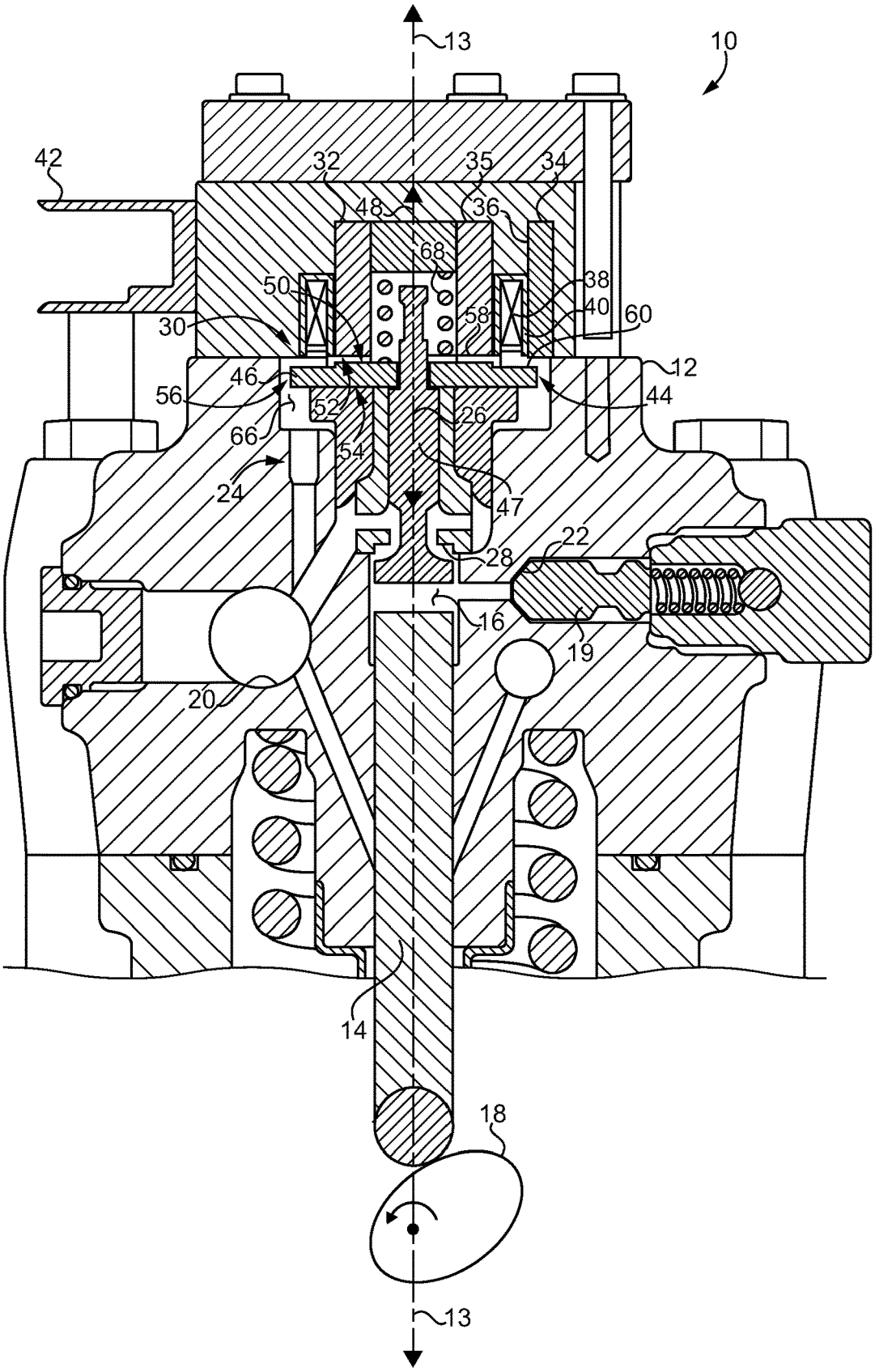
FIG. 1 is a sectioned side diagrammatic view of a pump, according to one embodiment.

Referring to FIG. 1, there is shown a pump 10 according to one embodiment and including a pump housing 12 defining a pump housing longitudinal axis 13. A pumping element in the nature of a plunger 14 is positioned within pump housing 12 and movable between an advanced position and a retracted position within a pumping chamber or plunger cavity 16. Plunger 14 is movable between the advanced position and the retracted position in response to rotation of a cam 18 in the illustrated embodiment. Pump 10 could be a fuel pump used, for example, to pressurize a fuel such as a diesel fuel for delivery to a common rail (not shown) that supplies pressurized fuel to a plurality of fuel injectors in an internal combustion engine. Pump 10 could alternatively be a so-called unit pump associated with a single fuel injector. In still other embodiments pump 10 might not be a fuel pump at all. Plunger 14 is the only plunger visible in the section plane of FIG. 1, however, those skilled in the art will appreciate that one or more additional plungers will typically be part of pump 10 and reciprocate, in-phase or out of phase, in response to engine cam rotation in a generally known manner. Plunger 14 can pressurize fuel within plunger cavity 16, and transition the fuel between a pump inlet 20 and a pump outlet 22. A valve member 26 of a valve assembly 24 is also positioned within pump housing 12 and movable between a rest position at which a valve seat 28 is open and pump inlet 20 is in fluid communication with plunger cavity 16, and an activated position at which valve member 26 blocks valve seat 28 and pump inlet 20 is blocked from fluid communication with plunger cavity 16. Valve member 26 could be positioned to block valve seat 28 during a pressurization stroke of plunger 14. A spring-biased outlet valve 19 blocks pump outlet 22, but opens in response to sufficient pressure to enable fluid communication between plunger cavity 16 and a common rail or other component to be supplied with pressurized fuel. Other valve positioning and operating strategies could be used. Valve member 26 could include a control valve that controls the position of another valve, for example. Valve assembly 24 also includes an electrical actuator 30, the operation and unique configuration of which is further discussed herein.

Electrical actuator 30 includes a stator 32 positioned within or coupled with pump housing 12, and an armature 44. Armature 44 may be coupled to valve member 26, and in an implementation can include an armature pin 47 that is attached to and/or formed integrally with valve member 26. Valve member 26 and/or armature pin 47 extends through armature plate 46. Armature 44 and armature plate 46 are terms used interchangeably herein. Changing an energy state of electrical actuator 30 can cause armature 44 to move according to well-known principles relative to stator 32. A change to the energy state will typically include electrically energizing electrical actuator 30, however, embodiments are contemplated where a change to the energy state includes deenergizing electrical actuator 30. Increasing an energy state of electrical actuator 30 from a first energy state to a higher energy state, or decreasing an energy state from a higher energy state to a lower energy state, could also be understood as changing an energy state as contemplated herein. In the illustrated embodiment, stator 32 includes an outer stator portion 34 having an annular shape, and an inner stator portion 35 also having an annular shape. Outer stator portion 34 and inner stator portion 35 can be concentrically arranged with one another, and centered on pump housing longitudinal axis 13, however, the present disclosure is not thereby limited. An annular channel 36 is formed between outer stator portion 34 and inner stator portion 35. In the illustrated embodiment, electrical actuator 30 includes a solenoid electrical actuator having a winding 38 that is positioned within or at least partially within channel 36. Winding 38 includes electrically conductive metallic material in a generally conventional manner. Electrical actuator 30 may also include a non-metallic overmolding 40 encasing winding 38. An electrical plug 42 is coupled with pump housing 12 to provide for electrical connections with winding 38. Stator 32 also includes a stator end face 52 ("stator face 52") that faces armature 44 and is formed in part by annular end faces (not numbered) of each of outer stator portion 34 and inner stator portion 35 that are positioned in a common plane, and also in part by winding 38. Overmolding 40 thus forms an exposed portion of stator face 52, the significance of which will be apparent from the following description.

Armature plate 46 defines armature center axis 48. At the state depicted in FIG. 1, armature center axis 48 is substantially collinear with pump housing longitudinal axis 13. Armature 44, including armature plate 46, is further movable between a rest position, corresponding to the rest position of valve member 26, and an activated position corresponding to an activated position of valve member 26. At the rest position of armature 44, armature plate 46 is spaced from stator 32. At the activated position of armature 44, armature plate 46 is adjacent to stator 32, with travel of armature 44 and valve member 26 typically stopped by contact of valve member 26 with valve seat 28. As noted above, armature 44 and valve member 26 are movable together in the described manner in response to a change to an energy state of electrical actuator 30. A return spring 68 may be provided for returning armature 44 and valve member 26 to the rest position once electrical actuator 30 is deenergized or otherwise suitably varied in energy state.

Figure 2:
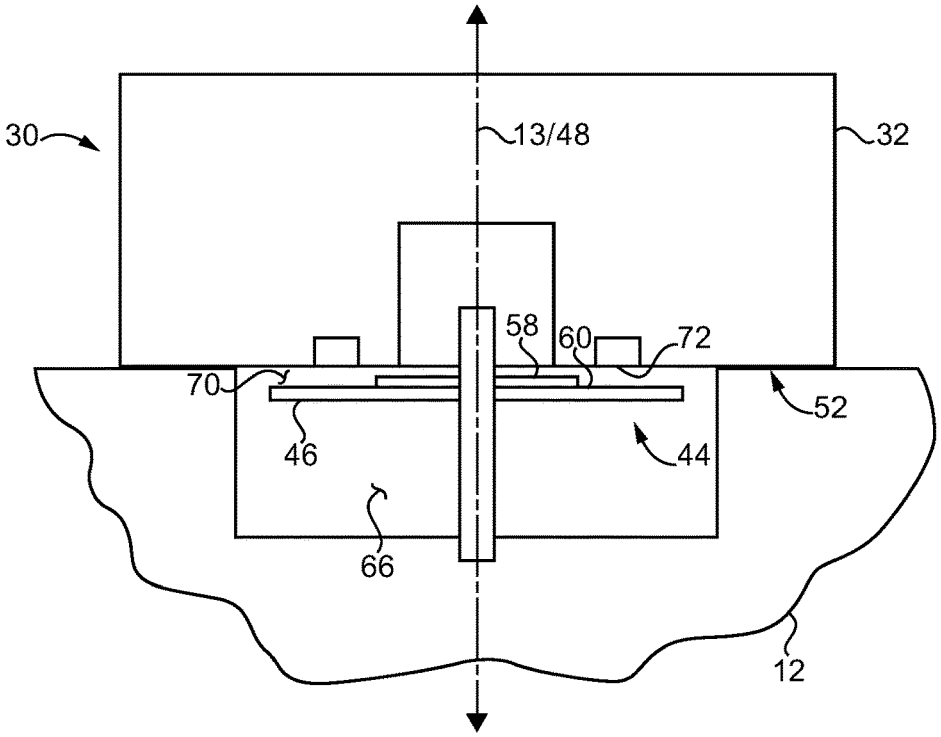
FIG. 2 is a diagrammatic illustration of portions of a valve assembly, in a first state, according to one embodiment.
Figure 3:
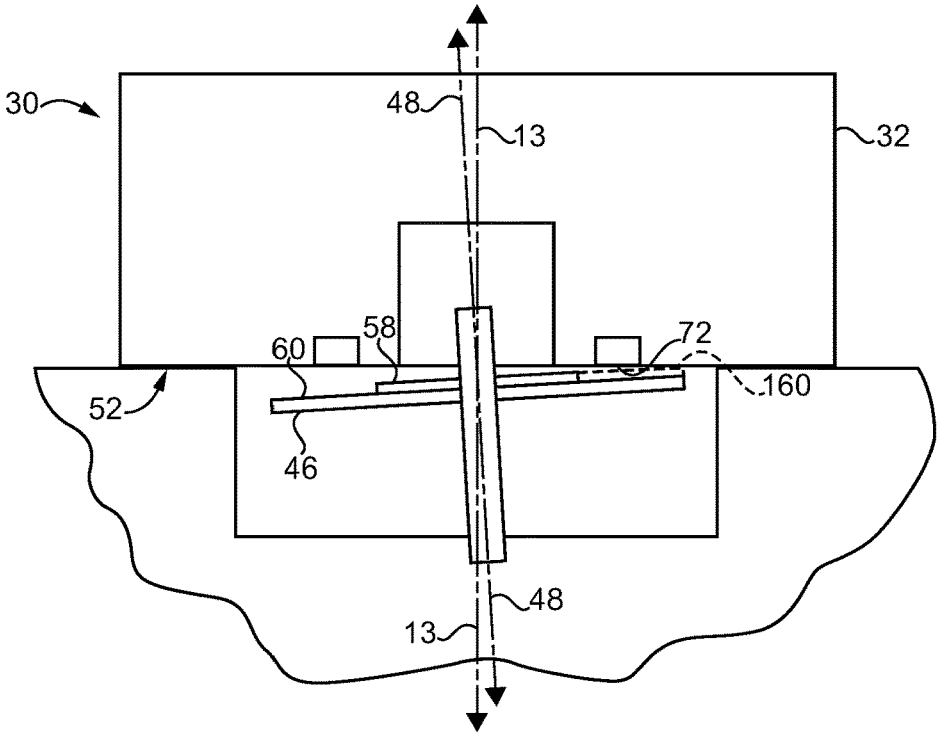
FIG. 3 is a diagrammatic view of the valve assembly of FIG. 2, in a second state.

Referring also now to FIG. 2, illustrating aspects and elements of electrical actuator 30 diagrammatically, armature plate 46 includes a top armature surface 50 facing stator 32, a bottom armature surface 54, and an outer perimetric surface 56 extending circumferentially around armature center axis 48 and axially between top armature surface 50 and bottom armature surface 54. Top armature surface 50 has an inwardly stepped-up profile that forms a raised surface 58 at a radially inward location that is adjacent to stator 32 at the activated position, and a lower, gap-forming surface 60 at a radially outward location that forms a gap 70 between armature 44 and stator 32 at the activated position. Inwardly stepped-up means an increase in elevation that is relatively abrupt in a direction radially inward toward armature center axis 48, although the "step" need not necessarily be sharp or angular. A continuous change in elevation would not likely be fairly understood as inwardly stepped-up, for example. Referring also to FIG. 3, there are shown aspects and elements of electrical actuator 30 as they might appear where armature 44 is at the activated position. At the activated position, armature center axis 48 is tilted relative to pump housing longitudinal axis 13, and thus top armature surface 50 is tilted relative to stator 32. In the illustrated embodiment an armature cavity 66 is formed in pump housing 12 to accommodate the motion of armature 44.

During operating pump 10 armature cavity 66 will typically be filled with the working fluid transitioned through pump 10, although of course other fluids could be used. When armature 44 is moved from its rest position, approximately as depicted in FIG. 2, to its activated position approximately as depicted in FIG. 3, it is necessary to displace fluid from between stator 32 and armature 44. In particular, as armature 44 is moved to its activated position fluid is squeezed between top surface 50 and stator face 52. It can further be noted that a slot 72 is shown in stator 32, and in the illustrated embodiment slot 72 extends inwardly from stator face 52. Slot 72 may have an annular shape, concentric with outer stator portion 34 and inner stator portion 35, and generally centered on pump housing longitudinal axis 13. It has been observed that the squeezing of fluid between armature 44 and stator 32, and particularly between armature 44 and slot 72, can result in a velocity and energy of the fluid that is sufficient, at least over time, to erode or otherwise damage overmolding 40. The inwardly stepped-up profile of top surface 50 ameliorates these erosive phenomena by providing an easier escape route for the displaced fluid. As noted above, top surface 50 includes raised surface 58 and lower surface 60. In earlier designs lacking an inwardly stepped-up profile no such escape route for fluid was provided. In FIG. 3, a phantom line illustrates an example armature profile 160 that can be found in certain known armature designs.

It will be recalled that moving armature 44 to the activated position can include tilting armature 44, ultimately such that a top surface 50 of armature 44 is tilted relative to stator face 52. It is believed that the tilting of armature 44, and some similar armatures, can cause or compound the phenomena potentially leading to erosion as described herein. It can be seen that the known armature profile 160 could result in armature plate 46 contacting stator 32 or nearly contacting stator 32 and limiting or preventing entirely a radially outward flow of fluid, at least in the vicinity of the point(s) of contact or near-contact between armature 44 and stator face 52, when armature 44 reaches the activated position. As a result, fluid being displaced could be expected to be redirected inwardly, circumferentially, and upwardly into slot 72, in the process being accelerated to the point that a jet(s) of high velocity fluid can damage the relatively soft overmolding 40.

Figure 4:
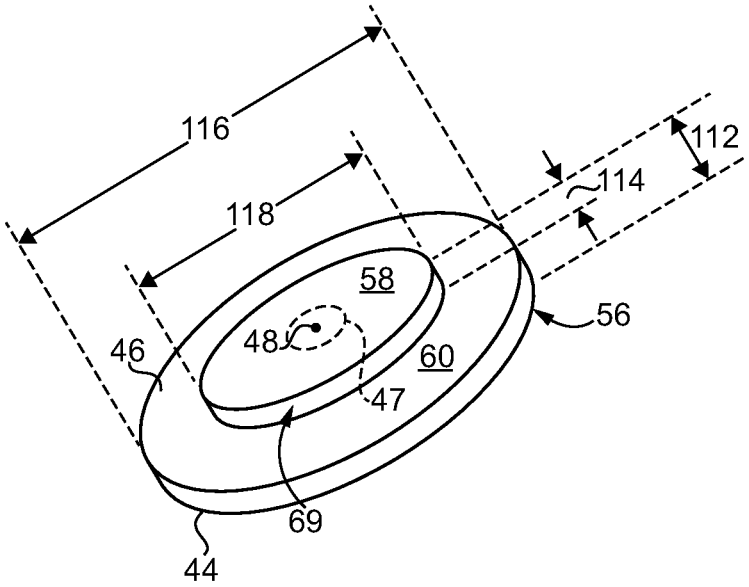
FIG. 4 is a perspective view of an armature for an electrical actuator, according to one embodiment.
Figure 5:
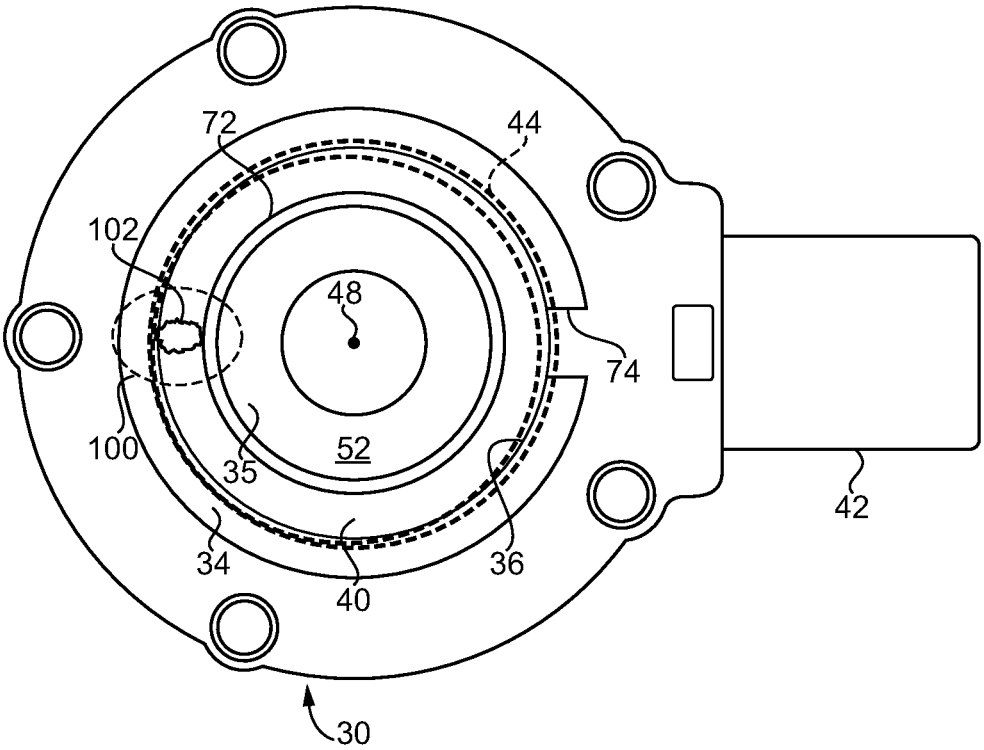
FIG. 5 is a bottom view of an electrical actuator including a stator, and an armature shown in phantom lines, according to one embodiment.

Turning now to FIG. 4, there is shown armature 44 including armature plate 46 in a perspective view and illustrating additional detail. It can be seen that raised surface 58 is generally planar and circular, and an annular step surface or outer perimetric surface 69 extends between raised surface 58 and lower surface 60. Lower surface 60 is also generally planar and annular. Raised surface 58 and lower surface 60 each extend circumferentially around armature center axis 48, and will be understood also to extend circumferentially around armature pin 47. It will further be noted from FIG. 4 that the inwardly stepped-up profile of top armature surface 50 is left-right symmetric about armature center axis 48. In an implementation, the inwardly stepped-up profile includes a profile of rotation that is circumferentially uniform about armature center axis 48, and each of raised surface 58 and lower surface 60 defines a circular perimeter, with the circular perimeters being concentric. Armature plate 46 has a first axial thickness 112 within raised surface 58 and a second axial thickness 114 within lower surface 60. First axial thickness 112 may be about twice second axial thickness 114, or less. Outer perimetric surface 56 defines a first outer diameter dimension 116, and raised surface 58 defines a second outer diameter dimension 118. First outer diameter dimension 116 may be about twice second diameter dimension 118, or greater. Magnetic flux density tends to weaken nonlinearly in directions radially outward from the center of a solenoid coil. For this reason, removing or limiting the use of material that is relatively more radially outward in an armature according to the present disclosure tends to have only a relatively mild effect, if any, on the magnitude of electromagnetic force applied to armature 44 when electrical actuator 30 is energized. It will be appreciated that various modifications to the geometry, proportions, and relative dimensions of armature plate 46 as depicted in FIG. 4 might be made without departing from the scope of the present disclosure. It is contemplated that a practical implementation includes forming armature plate 46 such that gap 70 will be in fluid communication with slot 72 when armature 44 is at the activated position. Accordingly, outer perimetric surface 69 can be positioned/sized slightly smaller than an outer diameter of slot 72, although the present disclosure is not thereby limited.

INDUSTRIAL APPLICABILITY

Referring to the drawings generally, operating valve assembly 24 can include changing an energy state of electrical actuator 30 as discussed herein, and moving armature 44 from the rest position toward stator 32 in response to the change to the energy state of electrical actuator 30. Armature 44 will move toward the activated position and be stopped at the activated position, such as by contacting valve member 26 with valve seat 28, although depending upon manufacturing tolerances, component wear, and the degree of tilting of armature 44, raised surface 58 could also contact stator face 52. At the activated position, lower surface 60 forms gap 70 such that fluid can be displaced from between armature 44 and stator 32 by way of gap 70. Valve 26 is moved in the manner described herein to vary fluid connections to pumping chamber or plunger cavity 16 in pump 10. When electrical actuator 30 is deenergized, armature 44 can move back toward the rest position under the influence of return spring 68.

Referring now to FIG. 6 there is shown a bottom view of electrical actuator 30 as it might appear where armature 44 is shown in phantom lines. It can be seen that armature 44 is tilted, generally to the left, away from plug 42 and away from a space 74 formed by a gap in outer stator portion 34. A circle 100 is shown about an area where contact between armature 44 and stator face 52 might be observed in a known design. Also shown is a location 102 where erosive or other damage could occur, but for the profile of armature 44 as described herein. It can be further noted that location 102 is within slot 72. In other pump and/or electrical actuator designs, different erosive phenomena could be observed.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A valve assembly comprising:

a valve member;

an electrical actuator including a stator, and an armature coupled to the valve member;

the armature including an armature plate defining an armature center axis, and being movable between a rest position and an activated position to vary a position of the valve member, in response to a change to an energy state of the electrical actuator;

the armature plate including a top armature surface facing the stator, a bottom armature surface, and an outer perimetric surface extending circumferentially around the armature center axis and axially between the top armature surface and the bottom armature surface; and the top armature surface having an inwardly stepped-up profile forming a raised surface at a radially inward location that is adjacent to the stator at the activated position, and a lower, gap-forming surface at a radially outward location that forms a gap between the armature and the stator at the activated position, and further comprising a housing defining a longitudinal housing axis, and the armature center axis is tilted relative to the longitudinal housing axis at the activated position.

2. The valve assembly of claim 1 wherein the valve member extends through the armature plate, and the raised surface and the lower, gap-forming surface each extend circumferentially around an armature pin.

3. The valve assembly of claim 2 wherein each of the raised surface and the lower, gap forming surface is planar, and the lower, gap-forming surface extends radially outward from the raised surface to the outer perimetric surface.

4. The valve assembly of claim 3 wherein the inwardly stepped-up profile is left-right symmetric about the armature center axis.

5. The valve assembly of claim 4 wherein the inwardly stepped-up profile includes a profile of rotation that is circumferentially uniform about the armature center axis.

6. The valve assembly of claim 5 wherein:

the armature plate has a first axial thickness within the raised surface and a second axial thickness within the lower, gap-forming surface, and the first axial thickness is twice the second axial thickness, or less; and the outer perimetric surface defines a first outer diameter dimension, and the raised surface defines a second outer diameter dimension, and the first outer diameter dimension is twice the second outer diameter dimension, or greater.

7. The valve assembly of claim 1 wherein:

the electrical actuator includes a solenoid actuator having the stator, a winding, and an overmolding encasing the winding;

the stator includes an annular outer stator portion and an annular inner stator portion, and a channel formed radially between the outer stator portion and the inner stator portion, and the winding and overmolding are received within the channel.

8. The valve assembly of claim 7 wherein:

the inner stator portion includes an inner stator end face and the outer stator portion includes an outer stator end face, and the inner stator end face and the outer stator end face are positioned in a common plane; and the overmolding has an annular slot formed therein that extends inwardly from the common plane, and the gap is in fluid communication with the annular slot at the second position of the armature.

9. A method of operating a valve assembly comprising:

changing an energy state of an electrical actuator of the valve assembly;

moving an armature coupled with a valve member in the valve assembly from a rest position toward a stator in the electrical actuator in response to the change to the energy state of the electrical actuator, the moving of the armature includes tilting a top surface of the armature forming the raised surface and the lower, gap-forming surface relative to the face of the stator;

stopping the moving of the armature at an activated position at which a raised surface at a radially inward location of the armature is adjacent to a face of the stator;

forming a gap at the activated position between a lower, gap-forming surface at a radially outward location of the armature and the face of the stator; and displacing a fluid from between the armature and the stator by way of the gap.

10. The method of claim 9 wherein the forming of the gap further includes forming the gap in fluid communication with a slot formed in the stator.

11. The method of claim 10 wherein the slot is formed in an overmolding of a solenoid winding of the electrical actuator.

12. The method of claim 11 wherein the displacing of the fluid further includes squeezing the fluid from between the armature and the face of the stator.

13. The method of claim 9 wherein the raised surface has a circular perimeter concentric with a circular perimeter of the lower, gap-forming surface.

14. The method of claim 9 wherein the valve assembly is within a pump, and the moving of the armature further includes moving the armature such that a position of the valve member is varied to vary fluid connections of a pumping chamber in the pump.

15. A valve assembly comprising:

a valve member;

an electrical actuator including a stator, and an armature coupled to the valve member;

the electrical actuator including a solenoid electrical actuator having the stator, a winding, and an overmolding encasing the winding;

the stator includes an annular outer stator portion and an annular inner stator portion, and a channel formed radially between the outer stator portion and the inner stator portion, and the winding and overmolding are received within the channel, the inner stator portion includes an inner stator end face and the outer stator portion includes an outer stator end face, and the inner stator end face and the outer stator end face are positioned in a common plane; and the overmolding has an annular slot formed therein that extends inwardly from the common plane, and the gap is in fluid communication with the annular slot at the second position of the armature;

the armature including an armature plate defining an armature center axis, and being movable between a rest position and an activated position to vary a position of the valve member, in response to a change to an energy state of the electrical actuator;

the armature plate including a top armature surface facing the stator, a bottom armature surface, and an outer perimetric surface extending circumferentially around the armature center axis and axially between the top armature surface and the bottom armature surface; and the top armature surface having an inwardly stepped-up profile forming a raised surface at a radially inward location that is adjacent to the stator at the activated position, and a lower, gap-forming surface at a radially outward location that forms a gap between the armature and the stator at the activated position.

* * * * *